United States Patent [19]

Saget

[11] Patent Number: 4,907,913

[45] Date of Patent: Mar. 13, 1990

[54] POINT OF JUNCTION OF TUBULAR METALLIC STRUCTURES, NOTABLY FOR DERRICK PLATFORMS

[75] Inventor: Pierre Saget, La Varenne, France

[73] Assignee: Societe Francaise d'Etudes d'Installations Siderurgiques, Montreuil Cedex, France

[21] Appl. No.: 458,052

[22] Filed: Jan. 14, 1983

[30] Foreign Application Priority Data

Jan. 14, 1982 [FR] France ..... 82 00521

[51] Int. Cl.[4] ..... E02B 17/00

[52] U.S. Cl. ..... 405/211; 405/195

[58] Field of Search ..... 405/195, 211, 216, 203, 405/204, 208, 227

[56] References Cited

U.S. PATENT DOCUMENTS

| | | | |
|---|---|---|---|
| 3,134,235 | 5/1964 | Parker et al. | 405/228 |
| 3,485,050 | 12/1969 | Martinovich | 405/195 |
| 3,550,384 | 12/1970 | Bardgette et al. | 405/227 |
| 4,425,054 | 1/1984 | Blondy et al. | 405/211 |

FOREIGN PATENT DOCUMENTS 2626867 12/1977 Fed. Rep. of Germany .

*Primary Examiner*—David H. Corbin

*Attorney, Agent, or Firm*—Wenderoth, Lind & Ponack

[57] ABSTRACT

A point of junction of tubular metallic structures, notably for derrick platforms, includes a tubular element on which are welded the tubes which form the point of junction. At least one steel stiffening element, formed of a cylindrical main portion coaxial with the tubular element and provided with annular ribs, is ferruled inside the tubular element with a ferruling rate sufficient for preventing it from being disunited from the tubular element.

3 Claims, 2 Drawing Sheets

POINT OF JUNCTION OF TUBULAR METALLIC STRUCTURES, NOTABLY FOR DERRICK PLATFORMS

FIELD OF THE INVENTION

The present invention relates to a point of junction of tubular metallic structures, notably for offshore derrick platforms.

Offshore derrick platforms are often formed of assemblies of tubular structure. Due to the particularly severe working conditions on such platforms, caused notably by swells, the fatigue strength of their components, and particularly of their points of junction, becomes a quite significant factor. Actually, the fatigue strength is a function of the rigidity of the tubes which are used for making the platforms. This is the reason why stiffening elements are disposed inside the tubes of the structure, in the positions of the intersections of the tubes or points of junction, when the diameter of such tubes is of a size allowing it. Such stiffeners, usually provided in the shape of rings, represent a very costly solution since their mounting in position involves notably soldering or welding operations inside the tubes.

OBJECTS AND SUMMARY OF THE INVENTION

The present invention aims at providing an economical solution, easy to put in practice and offering guarantees regarding safety, to the problems incurred in the fabrication of tubular assemblies of all sizes.

In this regard, the invention comprises a point of junction of tubular metallic structures, notably for derrick platforms, including tubular element on which are welded tubes to form the point of junction. At least one welded or moulded steel stiffening element, comprising a cylindrical main portion coaxial with the tubular element and provided with annular ribs, is ferruled inside the tubular element with a ferruling rate sufficient for preventing it from being disunited from the tubular element.

According to another feature of this invention, the stiffening element is formed by stacking a plurality of elementary stiffening elements ferruled inside the tubular element, each of the elementary stiffeners comprising a cylindrical portion and annular ribs.

According still to another feature of this invention, there are provided weld seams on the end ribs of the stiffening element or elements, in order to seal enclosures defined between the ribs relative to the tubular element, whereby the enclosures can subsequently be subjected to an overpressure or an under pressure in order to detect the possible presence of cracks through the tubular element at the level of the point of junction.

According still to another feature of this invention, the or each stiffening element can be provided with a network of longitudinal stiffeners.

BRIEF DESCRIPTION OF THE DRAWINGS

Other characteristics and advantages of the invention will become more apparent from the following description which is made with reference to the accompanying drawings, illustrating various embodiments thereof and without being limiting.

In the drawings.

DETAILED DESCRIPTION OF THE INVENTION

Figure 1:
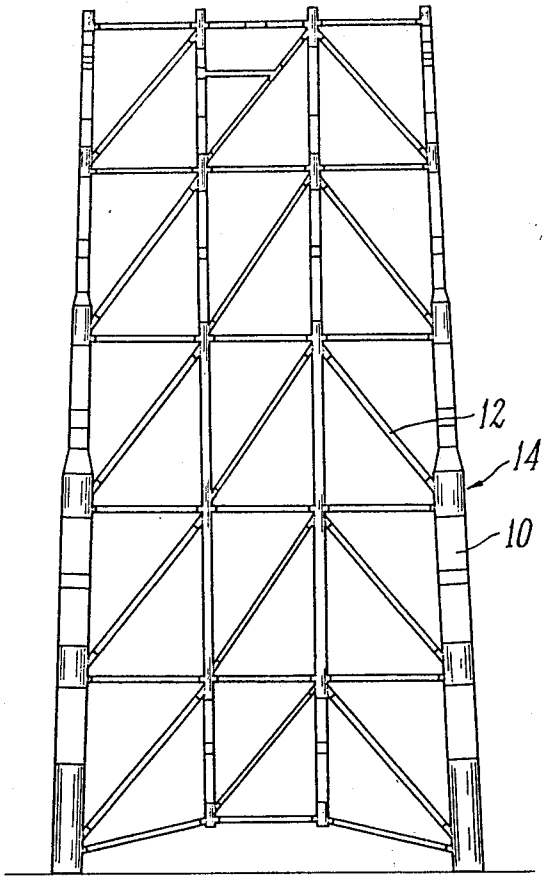
FIG. 1 is a schematic view showing a tubular structure for a derrick platform to which the present invention is applied.

FIG. 1 shows schematically a tubular structure of a derrick platform to which the invention can be applied, it being understood that this illustration is not limiting of the scope of the invention. As is known, this structure is made of an assembly of tubes 10, 12 of diameters of various sizes, and the invention relates to the points of junction, such as at 14, of the tubular structure.

Figure 2:
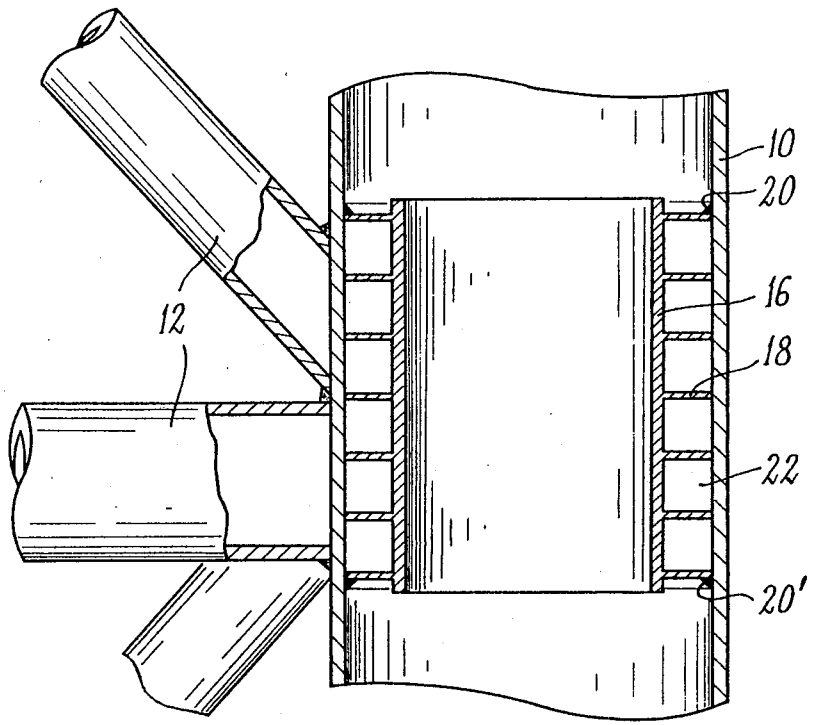
FIG. 2 is a partial vertical axial cross-sctional view of a point of junction provided with a stiffening element according to the invention.

Reference is now made to FIG. 2 which illustrates a first embodiment of the invention. In this Figure, one sees that the stiffening element according to the invention, disposed in the tubular element 10, comprises a tubular portion 16 coaxial with the tubular element 10, and annular ribs 18. The stiffening element, which can be made from welded or moulded steel, is ferruled or force-fitted inside the tubular element 10 with a ferruling rate sufficient for avoiding its disjunction by becoming loose.

In this embodiment, welding seams 20, 20' are provided on the periphery of the end ribs of the stiffening element. The inner bore of tube 10 can thus be isolated and the enclosures or chambers 22 defined between the consecutive ribs 18 sealed against the outside. By setting such enclosures 22 under a reduced pressure or an overpressure by injecting a gas therein, for example air, cracks which might form through the tubular element 10 can be detected, at the level of its connection with the tube 12.

Figure 3:
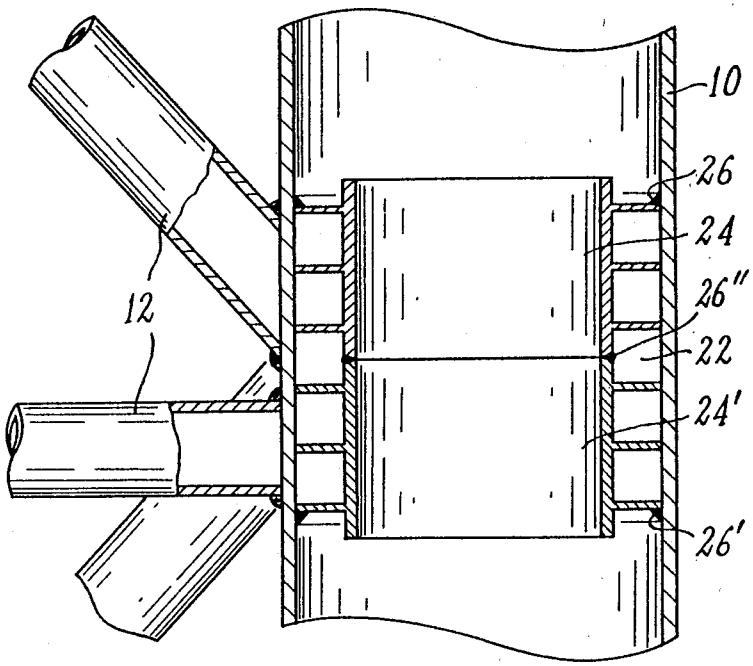

In the embodiment shown in FIG. 3, the stiffening element is made by plural axially connected members or stacked unitary elements (two in this example) 24–24', each of such elements exhibiting the characteristics of the stiffening element of FIG. 2. In the drawing are shown at 26, 26', 26 welding seams similar to seams 20, 20' of FIG. 2, and adapted for carrying out the same functions.

Figure 4:
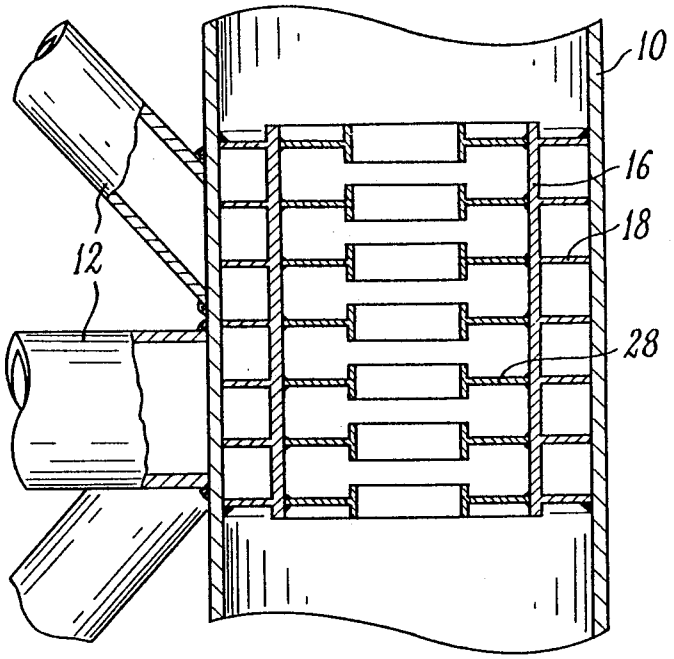
FIGS. 3 and 4 are views similar to FIG. 2, illustrating two alternative embodiments of the invention.

The alternative embodiment shown in FIG. 4 is different from that shown in FIG. 2 in that the stiffening element is provided with stiffening diaphragms or rings 28, which still increase the rigidity. The stiffening element can also be provided with a network of longitudinal or oblique stiffeners.

Among the advantages offered by the invention are the following:

ease of fabrication and mounting, by a simple ferruling operation in a tubular element of the structure, whatever the size of such element;

low cost and inexpensive assembly;

reduction of the concentration coefficient of stresses at the level of the points of junction, thereby improving the fatigue strength;

the possibility, after an inexpensive adaptation (welding seams on the end ribs), of detecting cracks through the tubular elements at the interconnections.

It is to be understood that the present invention is not limited to the various embodiments described and shown, and that it encompasses all its alternatives.

What I claim is:

1. In a point of junction of a tubular metallic structure, particularly for derrick platforms, of the type wherein a tubular element of the structure is reinforced by welding to the exterior of said tubular element at least one tube, the improvement of means for, at the area of connection to the exterior of said tubular element of said at least one tube, stiffening and increasing the rigidity of said tubular element and thereby increasing the fatigue strength thereof, said means comprising:

a stiffening element in the form of a tubular portion having extending outwardly therefrom at least three integral annular ribs; and said stiffening element being positioned within said tubular element in said area of connection to said exterior thereof of said at least one tube, with said tubular portion aligned coaxially of said tubular element, with said annular ribs being force fit to the interior of said tubular element to an extent to be prevented from being disconnected therefrom during use of said structure, and with axially opposite endmost of said ribs welded to said tubular element, thereby defining at least two internally sealed chambers between said stiffening element and said tubular element.

2. The improvement claimed in claim 1, wherein said tubular portion comprises plural axially connected tubular members, each having extending outwardly therefrom a plurality of said integral annular ribs.

3. The improvement claimed in claim 1, wherein said tubular portion has integral stiffening diaphragms.

* * * * *